United States Patent [19]

Lunden

[11] 4,378,558

[45] Mar. 29, 1983

[54] ENDFIRE ANTENNA ARRAYS EXCITED BY PROXIMITY COUPLING TO SINGLE WIRE TRANSMISSION LINE

[75] Inventor: Clarence D. Lunden, Federal Way, Wash.

[73] Assignee: The Boeing Company, Seattle, Wash.

[21] Appl. No.: 174,453

[22] Filed: Aug. 1, 1980

[51] Int. Cl.[3] ..... H01Q 1/28

[52] U.S. Cl. ..... 343/814; 343/785; 343/DIG. 2; 333/240

[58] Field of Search ..... 343/785, 895, 771; 333/240

[56] References Cited

U.S. PATENT DOCUMENTS

| | | | |
|---|---|---|---|
| 2,130,675 | 9/1938 | Peterson | 343/811 |
| 2,192,532 | 3/1940 | Katzin | 343/811 |
| 2,624,003 | 12/1952 | Iams | 343/771 |
| 2,685,068 | 7/1954 | Goubau | 333/95 |
| 2,688,732 | 9/1954 | Kock | 333/95 |
| 2,921,277 | 1/1960 | Goubau | 333/240 |
| 2,929,065 | 3/1960 | Kreinheder | 343/785 |
| 2,993,205 | 7/1961 | Cooper | 333/240 |
| 3,002,189 | 10/1961 | Butler | 343/793 |
| 3,136,996 | 6/1964 | Parker | 343/106 |
| 3,155,975 | 11/1964 | Chatelain | 343/785 |
| 3,219,954 | 11/1965 | Rutelli | 333/95 |
| 3,283,330 | 11/1966 | Chatelain | 343/785 |
| 3,328,800 | 6/1967 | Algeo | 343/771 |
| 3,373,434 | 3/1968 | Lorenzo et al. | 343/895 |
| 3,392,396 | 7/1968 | Ehrenspeck | 343/755 |
| 3,509,572 | 3/1970 | Barbano | 343/792.5 |
| 3,541,568 | 11/1970 | Lowenhar | 343/877 |
| 3,771,077 | 11/1973 | Tischer | 333/95 S |
| 3,811,633 | 5/1974 | Cummings et al. | 242/54 A |
| 3,935,576 | 1/1976 | Pickles | 343/761 |
| 4,278,955 | 7/1981 | Lunden | 333/33 |

FOREIGN PATENT DOCUMENTS

| | | | |
|---|---|---|---|
| 146804 | 3/1959 | U.S.S.R. | 343/785 |

OTHER PUBLICATIONS

"Antennas," Lamont V. Blake, John Wiley & Sons, pp. 196–201, 230–233, 248–251.

"Antenna Fundamentals," pp. 24–29.

Jasik, Henry, Ed.; Antenna Engineering Handbook; 1961; pp. 16–34 through 16–36, 16–40 through 16–41, 16–56 and 16–57.

*Primary Examiner*—Eli Lieberman

*Attorney, Agent, or Firm*—Christensen, O'Connor, Johnson & Kindness

[57] ABSTRACT

A lightweight, efficient, microwave power transmitting antenna is disclosed, suitable for use in a space borne transmitter for beaming solar generated electrical power down to earth based receiving antennas. The space borne antenna structure is formed by modules that are structurally integrated into a multimodule antenna array. Each module comprises a rectangular framework of limited depth having rigid sides circumscribing a generally open region in which a plurality of spaced parallel single wire Goubau transmission lines are strung to create a "see-through" harp-like configuration. A Klystron powered feed wave guide is disposed as one structural side of the module for exciting standing electromagnetic waves on the plurality of Goubau lines. Printed circuit Yagi endfire radiators are supported on dielectric webs disposed in juxtaposition with the Goubau lines for being synchronously excited by the standing waves on such lines. The modular, open framework construction together with the use of single wire Goubau transmission lines for exciting the web mounted Yagi radiators, forms an exceptionally lightweight structure which when disassembled can be consolidated in a high density package for being launched into orbit, and then subsequently assembled in space.

22 Claims, 8 Drawing Figures

ENDFIRE ANTENNA ARRAYS EXCITED BY PROXIMITY COUPLING TO SINGLE WIRE TRANSMISSION LINE

BACKGROUND OF THE INVENTION

The invention relates to antenna arrays of the type in which the radiating elements are excited by proximity coupling to a source of electromagnetic surface waves developed on an adjacent conductive structure.

While the invention broadly concerns antenna arrays having the foregoing characteristics, a preferred form of the invention, as disclosed herein, is deployed as a space borne, earth directed beam antenna for transmitting solar-to-electrical converted power earthward for collection by ground based receiving antennas.

It has previously been proposed that solar power can be efficiently converted to electrical power at space borne satellites and then transmitted to earth in the form of microwave electromagnetic energy, which as used herein refers to the higher frequencies of the radio band, such as from about 300 megahertz to 4,000 megahertz. By collecting solar energy in large surface area arrays of solar cells located in orbit above earth's atmosphere, a significantly greater degree of the available solar energy can be captured and transformed into electrical power than is possible using earth based solar cells. After the solar-to-electrical power conversion however, it becomes necessary to provide means for efficiently transmitting the electrical power to earth. For this purpose, it has been proposed that the satellite structures that support the arrays of solar cells be adapted to mount high frequency transmitting equipment for transforming the solar-derived electrical power into high frequency electromagnetic energy and for beaming such energy earthward to ground based receiving antennas. At frequencies suitable for transmitting relatively large amounts of power through the atmosphere, antenna structures in the microwave band are considered most effective.

One proposed transmit antenna structure for this purpose comprises rafts of juxtaposed microwave guides, each of rectangular cross section and slotted along the larger dimension face of each wave guide, in a known manner, for collectively radiating a highly directional beam of radiated electromagnetic energy. By creating large planar arrays of such rafted wave guides, a relatively efficient transmit antenna can be created. While such an antenna configuration is feasible, there are certain disadvantages inherent in its structure which would be desirable to overcome or avoid. First, the slotted wave guide raft configuration when assembled in space, results in a relatively heavy, bulky structure. Additionally, the nature of the component wave guides are such that the structure is highly susceptible to overheating due to the combined efforts of resistive losses in the structure during the transmission of power, and due to the interception of solar energy as a result of the closed face configuration inherent in its architecture.

Furthermore, there has not been a satisfactory proposal for arranging the components in a high density package for being launched into satellite orbit for assembly in space. The antenna structures that must be used, when assembled in space, are of a flattened configuration spanning a relatively large area, and are arranged to face the earth, so as to achieve the cumulative power transmitting capability necessary for beaming useable amounts of electrical power to earth. Because of this generally planar configuration of the antenna structure, it is not practical to launch an assembled antenna into orbit; rather, the constituent elements for the antenna arrays must be consolidated in high density pay load packages and launched in this form into space and assembled by crews while in a stable orbit. This requirement places a severe constraint on the nature and shape of the ultimate structure, and more especially on the components that are used to assemble the final structure. Also, the weight-to-power capability of the antenna arrays becomes an important factor and desirably this ratio is held to a minimum so that each launched payload package has that much greater value in terms of transmitting power versus cost capacity.

Preliminary studies show that a six-foot by six-foot array of rafted, slotted wave guides may have an earth weight in the neighborhood of 120 to 160 lbs. For overall efficiency of the satellite power station, it has been estimated that the total weight for an antenna module having a comparable level of power transmitting capability, should be around 20 lbs., far less than the projected weight of the previously proposed antenna structure.

In addition to the above factors, a practical antenna array for this purpose must have a high degree of rigidity in order to obtain phase stability needed for power transmission efficiency. All elements of an antenna array must have a predetermined, constant phase relationship in order to produce a predictable and stable set of propagating wave fronts which constructively combine to form the directional characteristics of a beam. If excessive expansion, contraction, twisting, or other deformation of the antenna structure occurs in reaction to the environmental conditions in space, such as the above-mentioned solar pressure, then certain sections of the array will exhibit phase shifts with respect to other elements, thereby reducing the overall beam-forming capability of the array.

Accordingly, it is one object of the invention to provide an antenna array suitable for use as the transmit antenna in a solar driven satellite power station, in which the electrical and structural characteristics of the array overcome one or more of the foregoing disadvantages or difficulties associated with previously proposed configurations.

Another object of the invention is to provide an antenna array for such a space power station that combines electrical and mechanical properties to yield a novel antenna structure characterized by a high degree of transmit efficiency and beam forming phase stability when arrayed in a generally planar structure that extends over the large area needed to transmit useful levels of electrical power earthward.

Still a further object of the invention is to provide a novel antenna structure for microwave frequencies which is characterized by being relatively light in weight, having an open lattice structure that is substantially transparent to solar heat, and being sufficiently rigid so as to achieve a high degree of phase stability.

An additional object of the invention is to provide a modular antenna structure for use in a space power satellite station of the type described above, in which the antenna is characterized by: a high-transmit efficiency such that when a plurality of similar modules are arrayed over a large planar area, the resulting structure is capable of transmitting sufficient electromagnetic energy to be useful for beaming electrical power earthward; a high degree of phase stability to form a concentrated beam of transmitted electromagnetic energy; a low weight-to-power handling ratio; an open framework "see-through" configuration for withstanding solar radiation pressure incident on space borne structures; and an architecture composed of interconnectible elements which prior to assembly have a suitably form factor for being packaged in a high density pay load for being launched into orbit by available propulsion means.

SUMMARY OF THE INVENTION

The principles of the invention are broadly embodied in an antenna structure comprising a single wire transmission line, energized by microwave electromagnetic energy, and one or more endfire parasitic antenna arrays, such as a Yagi radiator, arranged transversely to the single wire transmission line and in such proximity thereto that standing waves on the single wire line are proximity coupled to the endfire array.

In a preferred form of the invention, the single wire transmission line is a conductor having its surface modified so as to reduce the phase velocity of the associated electromagnetic energy waves and thereby concentrate the field of the waves to a relatively confined cylindrical region coaxial with the conductor. More specifically, such a single wire transmission line is sometimes called a Goubau line, after the name of the inventor, and is more fully disclosed in U.S. Pat. No. 2,685,068 issued July 27, 1954.

These principles of the invention are preferably incorporated in a transmit antenna structure for a space power satellite, in which a plurality of the Goubau transmission lines are stretched in spaced parallel fashion between opposed side members of a rigid, open center framework, and a plurality of Yagi radiators are proximity coupled to each of the parallel Goubau transmission lines. The Goubau lines themselves are excited with standing surface waves by a feed wave guide configured and arranged as one of the structural sides of the framework. Electromagnetic waves in the feed wave guide are coupled onto an end of each of the Goubau lines so as to launch the standing electromagnetic surface waves that in turn excite the plurality of Yagi radiators.

Preferably, the Yagi radiators are provided by preformed strips of conductive material disposed on a thin dielectric web stretched between the same sides of the framework that anchor the Goubau lines. By properly indexing the strips of conductive material that form the Yagi radiators with the Goubau line, a driven element of each Yagi radiator is proximity coupled to a standing wave on the Goubau line. By pointing the plurality of Yagi radiators in the same transverse direction relative to the parallel Goubau lines, an array is formed in which the radiated waves constructively combine to form a directional beam of radiated electromagnetic energy which can be aimed earthward.

In order to provide adequate power transmitting capability, a plurality of transmit antenna modules are required, each having a framework as characterized above that supports a plurality of parallel Goubau lines and each such line has an associated set of Yagi radiators. The modules are physically integrated so that the feed wave guide of one module forms a rigid structural side member of an adjacent module. By cascading a plurality of such modules over a large generally planar area, a transmit antenna structure having adequate efficiency and phase stability is obtained with a significant reduction in weight-to-power capability compared to previously proposed space borne transmit antenna configurations.

To provide a complete disclosure of the invention, reference is made to the appended drawings and following description of one particular and preferred embodiment.

DETAILED DESCRIPTION

Figures 1, 2:
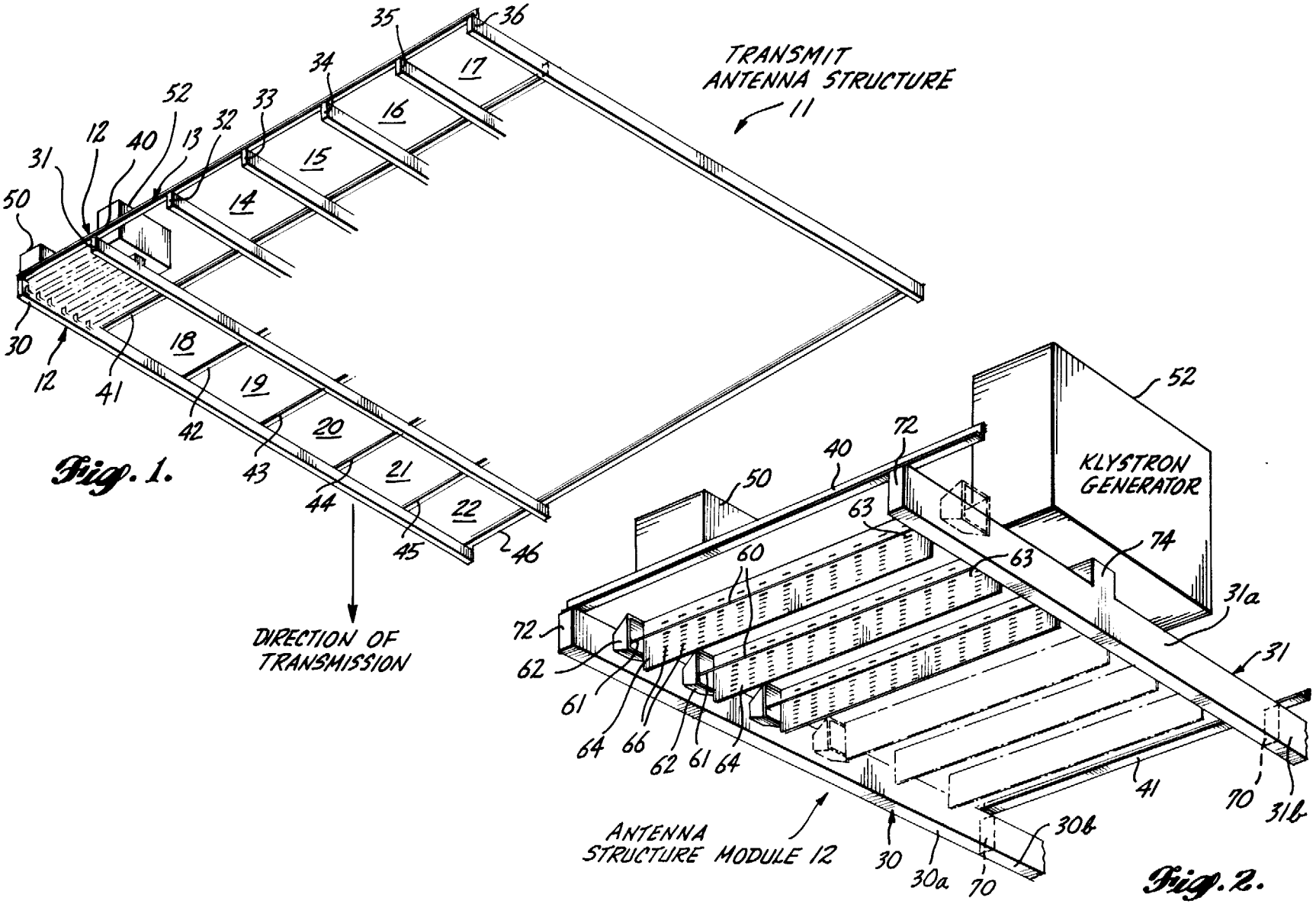
FIG. 1 is a perspective, fragmentary view of a currently preferred embodiment of the transmit antenna structure, for a space power satellite, as seen from below looking generally upward toward the orbiting structure.
FIG. 2 is a similar perspective view of one module of the antenna structure of FIG. 1.

With reference to FIG. 1, a transmit antenna structure 11 is shown, suitable for use as a component of a space power satellite, for beaming microwave power earthward for reception by ground base receiving antenna arrays. Antenna structure 11 is composed of a structurally and electrically integrated, rectangular array of individual antenna modules such as shown in FIG. 1 by a row of modules 12, 13, 14, 15, 16 and 17, and a column of modules sharing module 12 and further including modules 18, 19, 20, 21 and 22. Thus, structure 11 is in this example composed of 36 modules in a six by six rectangular array. Each of these plurality of modules is energized by a partitioned section of one of a plurality of spaced parallel, dual purpose feed wave guide and frame members 30, 31, 32, 33, 34, 35 and 36 extending along the columns of the arrayed modules 12–22. Extending orthogonally to members 30–36 are a plurality of spaced parallel frame members 40, 41, 42, 43, 44, 45 and 46 such that each of the above-mentioned plurality of modules 12–22 is circumscribed by segments of adjacent pairs of members 30–36 and an orthogonal set of segments of adjacent pairs of members 40–46.

As described more fully hereinafter, the areas circumscribed by orthogonal sets of members 30–36 and members 40–46 contain a plurality of single wire transmission lines energized by the feed wave guides provided by members 30–36, and a plurality of Yagi endfire radiators, supported on dielectric webs, and electromagnetically coupled by proximity to the single wire transmission lines for radiating standing wave electromagnetic energy existent on such lines away from the generally defined plane of structure 11. Thus, the plane of structure 11 is oriented in space so that the emitted electromagnetic energy radiates therefrom in a direction perpendicular to the plane of the array and earthward toward receiving antenna arrays spread over acres of area on the earth's surface. Each of the modules of structure 11 is provided with a power source in the form of a Klystron generator as indicated for example by generator 50 for module 12 and generator 52 for module 13. Klystron generators 50 and 52 are in turn powered by solar energy converted to electricity by large arrays of solar cells (not shown) orbiting in space adjacent the transmit antenna structure 11. Although antenna structure 11 is in this embodiment shown to include 36 modules in a six by six array, it will be appreciated that structure 11 can be expanded in the principal plane, to span almost any desired area by adding to and/or extending dual purpose, feed wave guide and frame members 30–36 and frame members 40–46.

With reference to FIG. 2, the construction of one of the antenna modules 12 is shown in greater detail to include a plurality of spaced parallel single wire transmission lines 60 strung between a segment 30*a* of feed wave guide and frame member 30, and an opposing segment 31*a* of member 31. Member segment 30*a* is charged with electromagnetic energy by Klystron generator 50 and such energy is in turn coupled onto lines 60. As described in greater detail below, transmission lines 60 are preferably provided by Goubau lines (G-lines) in which the surface of the conductive member is modified such as by the provision of a coating or sheath of dielectric material for reducing the phase velocity of surface waves traveling along the line.

Figure 3:
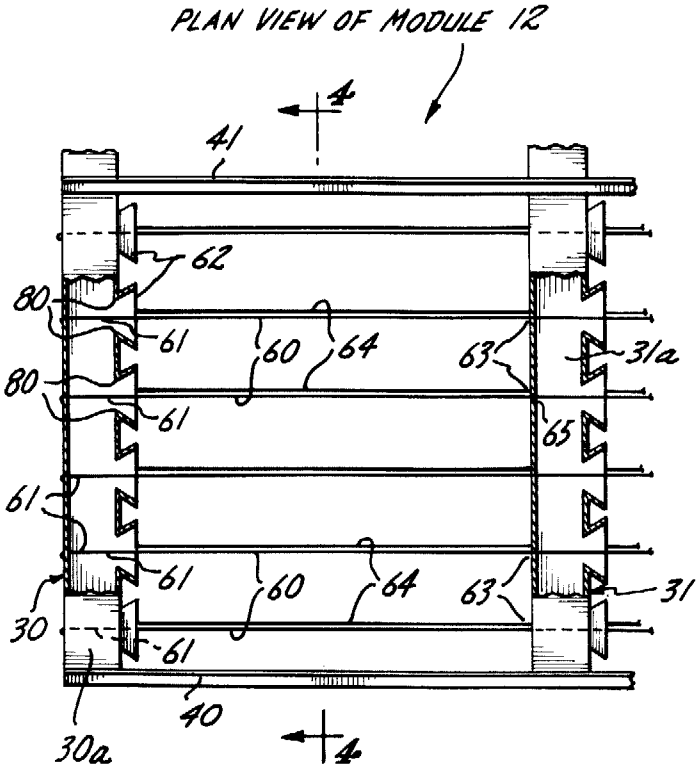
FIG. 3 is a plan view of the module shown in FIG. 2.

The fed ends 61 of lines 60 are electromagnetically coupled to segment 30*a* of feed wave guide and frame member 30 by a corresponding plurality of wave launching horns 62 by extending these ends 61 into member segment 31*a* through horns 62 and electrically shorting ends 61 to the rear interior wall of segment 30*a*, as shown by FIG. 3. The opposite ends 63 of line 60 are electrically shorted to a rear exterior wall of segment 31*a* of member 31 as shown in greater detail in FIG. 6 such that standing waves of number and length related to the frequency of the source of microwave energy, are developed along each of lines 60. There is no electromagnetic coupling between the feed wave guide provided by segment 31*a* and the transmission lines 60 of module 12. Rather, the wave guiding interior of segment 31*a* of member 31 serves as the feed wave guide in conjunction with Klystron generator 52, for energizing the plurality of transmission lines of module 13, corresponding to lines 60 of module 12. Thus, segment 31*a* of member 31 serves solely as a structural element of module 12, providing an anchor point for the nonfed ends 63 of transmission lines 60.

Mounted in juxtaposition with the transmission lines 60 are a corresponding plurality of dielectric webs 64, one for each line 60, each for supporting a plurality of printed circuit, endfire parasitic antennas or radiators 66, preferably in the configuration of Yagi radiators. Radiators 66 are arranged on dielectric webs 64 so that the direction of end fire propagation from each radiator extends orthogonally to the associated transmission line 60 and normal to the plane containing the parallel lines 60. The driven element of each radiator 60, as described more fully below, is proximity coupled to the associated transmission line 60. By proximity coupling a driven element of each of radiators 60 to standing electromagnetic waves on the associated line 60, high frequency electromagnetic energy originating in generator 50 is fed by feed wave guide segment 30*a* of member 30 to wave launching horns 62 and hence onto single wire G-lines 60. There standing waves are formed and then radiated away from structure 11 by Yagi radiators 66 in a direction orthogonal to the plane of the antenna array. Dielectric webs 64 are strung, alongside of wires 60 and are anchored at one of their ends to the corresponding wave launching horns 62, and at their opposite ends to the rear exterior wall of wave guide and frame member segment 31*a*. One preferred anchoring arrangement for webs 64 is described in greater detail in connection with FIG. 6. Although the number of single wire transmission lines 60 and associated Yagi radiator supporting webs 64 can vary within the limits of the physical space available in any given module 12, in this particular embodiment, a plurality of six single wire transmission lines and associated webs 64 are accomodated between segments 30*a* and 31*a* of the wave guide and frame members 30 and 31. The individual frame members 30–36 and 40–46 each provide lengthwise rigidity and stiffness such that when they are assembled with the plurality of spaced parallel G-lines 60, and the latter are tensioned to draw the modules and structure 11 together in a "harp-like" configuration, a precise design dimension and shape is achieved. Such precision is necessary to provide the designed phase relationship and phase stability between the arrayed elements so that the electromagnetic waves radiated by the plurality of Yagi radiators 66 constructively combine to form a relatively high gain transmission beam.

To facilitate the drawing of the various structural components into a rigidified whole, the G-lines 60 may be extended in a continuous fashion from module to module by passing each tensioned line through a suitably sized aperture in the nonported side wall of each of wave guide and frame members 31–35. Thus, with reference to FIGS. 3 and 6, lines 60 pass under tension, through apertures 65 in the nonported side wall of member segment 31*a*, and thence on into module 13. For proper antenna operation, each line 60 must be electrically joined to the conductive nonported side wall of segment 31*a* and to each corresponding side wall of the members 32–36 of succeeding modules 13–17 (FIG. 1). Thus, the apertures 65 which allow for relative slippage of lines 60 for structural tensioning purposes, must be sized to provide adequate electrical contact with the line conductors. The ends of lines 60 at the terminal edges of structure 11, such as at member 30, are both electrically bonded and mechanically anchored as indicated at ends 61 of module 12 shown in FIG. 3.

Each of members 30–36 are provided by an elongate tubular member, here being of rectangular cross section selected for guiding electromagnetic waves of a suitable wave length for developing the above-mentioned standing waves on G-lines 60. For example, a rectangular wave guide construction in which interior conductive walls of members 30–36 are two inches by three and a half inches for guiding waves in a $TE_{10}$ mode at a frequency of 2,450 megahertz ($\lambda_0$ equals five inches) is satisfactory. Since each of the Klystron generators 50, 52 drive a single one of the plurality of antenna modules 12–22, the feed wave guides provided by members 30–36 are separated into segments by electrically conductive partition walls 70 as shown in FIG. 2. Thus, a partition wall 70 divides member 30 into a first wave guide segment 30*a* for receiving high frequency electromagnetic energy from Klystron generator 50 and distributing such energy to the plurality of six G-lines 60. Where any of the modules terminates along a side edge of antenna structure 11, the corresponding ends of members 30–36 are capped off by end walls 72, as shown in FIG. 2. While generators 50, 52 may be mounted at any suitable location relative to the associated feed wave guide segment, in this instance, they are arranged on the opposite side of the plane of structure 11 from the direction of radiation by Yagi radiators 66 and are coupled to the associated wave guide segments by T-coupling junctions as indicated for example by junction 74 for coupling generator 52 to a mid-point of the feed wave guide provided in member segment 31*a*.

The spacing between adjacent pairs of wave guide and frame members 30–36 is not critical. By way of example, in the present embodiment, an intermember spacing of six feet has been used, with a corresponding spacing of six feet between adjacent pairs of frame members 40–46, so that each module forms a six feet square. Frame members 40–46 are for structural purposes only, and are hence selected to provide adequate structural rigidity with the least possible weight. In this embodiment, angle bars are used for members 40–46 in which one leg of the bar is fastened to an exterior wall portion of members 30–36 on a side thereof opposite the direction of transmission, and hence on the same side of the antenna structure 11 as Klystron generators 50, 52. The remaining leg of angle bar members 40–46 projects away from the plane of the antenna structure as shown in FIG. 2.

Figure 4:
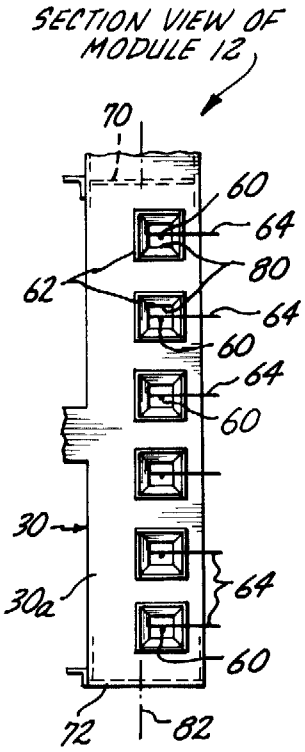
FIG. 4 is a sectional view of the module as taken along a section indicated by line 4—4 in FIG. 3.

With reference to FIGS. 3 and 4, each of the plurality of wave launching horns 62 of module 12 are in this embodiment shaped in the form of a truncated pyramid. The smaller and truncated end of each thusly shaped horn 62 is congruently mated to a square shaped port 80 formed in the larger side wall of the feed wave guide in member segment 30*a* as shown in FIG. 3. The larger or flared end of each horn 62 projects away from the side wall of member segment 30*a* and inwardly toward the central area of the module. The centers of each of ports 80 associated with wave launching horns 62 are offset from a centerline (see dotted line 82 and FIG. 4) of the side wall of segment 30*a* in order to extract and equally distribute electromagnetic energy, existing in the above-mentioned $TE_{10}$ transmission mode, onto G-lines 60. The degree of offset of the centers of ports 80 relative to centerline 82 of wave guide member segment 30*a* is determined empirically by adjusting the position of test ports on a prototype wave guide until the energy level extracted from the wave guide is substantially equal at all six ports 80 and associated horns 62.

Each G-line 60 is strung between member segments 30*a* and 31*a*, so that the lines enter port 80 at the center thereof and extend interiorally across the narrow width of member segment 30*a* where the end of the transmission line is electrically and in this case mechanically anchored, such as by welding or soldering, to the side wall of the wave guide opposite the associated launching horns 62. Horns 62 are coupling devices, known per se, which provide for efficient coupling of the guided electromagnetic energy that initially is confined to the interior of segment 30*a*, onto the G-lines 60 by reshaping the electromagnetic field that is coaxial with the associated line 60. As an alternative embodiment, horns 62 may each be in the shape of a truncated cone, rather than the truncated pyramid shape that is provided in the presently disclosed embodiment.

Figure 5:
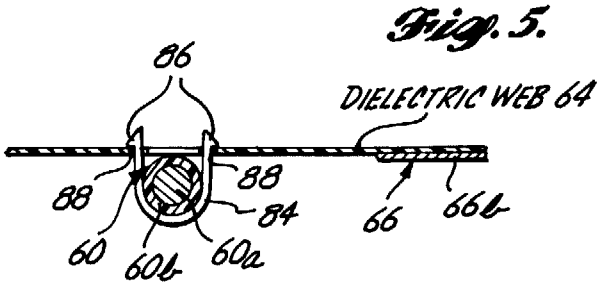
FIG. 5 is a detail, sectional view of one Goubau transmission line and a fragment of the dielectric web and Yagi radiator associated with such line.

With reference to FIG. 5, the currently preferred embodiment employs a particular type of single wire transmission line for lines 60, in which the outer surface of the line conductor is modified so as to reduce the phase velocity of the electromagnetic surface waves guided by the line. Such a surface modified single wire transmission line is sometimes referred to as a Goubau- or G-line and the construction and nature of such G-lines are fully disclosed in U.S. Pat. No. 2,685,068 for SURFACE WAVE TRANSMISSION LINE, issued July 27, 1954 to G. J. E. Goubau, the disclosure of which is incorporated herein by reference. While the surface of such single wire transmission line may be modified in different ways to achieve the reduced phase velocity, in the presently disclosed and currently preferred embodiment, a round wire conductor 60*a* of line 60 is provided with a dielectric sheath 60*b*, made of a material such as polytetraflouroethylene or polyethylene. By way of example, the wire conductor 60*a* may be of copper or aluminum and may be silver plated and of one-eighth to one-quarter inch in diameter. The thickness of the dielectric sheath 60*b* may be from 0.005 to 0.020 of an inch. The resulting assemblage is a relatively low loss transmission line in which the electromagnetic energy flows therealong in a concentrated cylindrical region coaxial with the wire, rather than being radially unbounded, as in the case of the hereinafter described single wire line locking surface modification. By employing the surface modified conductor in accordance with the Goubau single wire transmission line, teaching, as currently preferred, standing wave electromagnetic energy can be developed on line 60 in a coaxial region concentrated close to the line so as to allow for efficient coupling to a conductive driver element of each of the plurality of Yagi radiators 66.

The dielectric sheath 60*b* removed at the locations along each of line 60 where they pass through the apertures 65 in the rear walls of members 31–35, to allow for the above-mentioned electrical contact therebetween.

Lines 60 also have a desirable form factor in that a continuous length of line material can be coiled into a high density package for being launched into space, and then unwound and strung onto members 30–36 to assemble the structure 11.

In providing proximity coupling (as contrasted with a metallic connection) to Yagi radiators 66, line 60 must be proximity indexed to the conductive elements of the radiators. This is achieved in the currently preferred embodiment by using a plurality of U-shaped clips 84 made of a resilient dielectric material, and having outwardly opposed catch portions 86 on outwardly biased ends thereof. Cooperating with each clip 84 are a pair of apertures 88 provided in dielectric web 64 at a predetermined transverse location relative to the conductive elements of Yagi radiators 66. A plurality of sets of apertures 88 are thus provided at intervals along the lengthwise dimension of web 64 and clips 84 are fitted around G-lines 60 and the catch portions 86 are inserted into apertures 88 and hence locked in place, securing line 60 in juxtaposition with one face of web 64.

Figure 6:
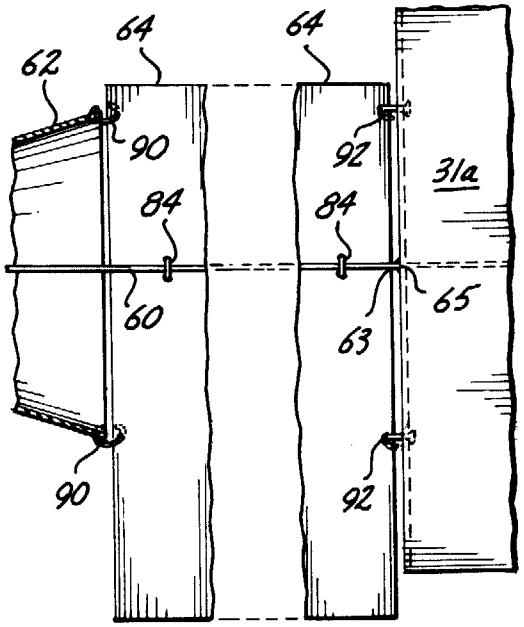
FIG. 6 is another detail view of one of the Goubau lines and associated dielectric web showing the anchoring of the ends of such line and dielectric web to the frame of the antenna structure module.

With reference to FIG. 6, each of dielectric webs 64 is held taut between the spaced parallel segments 30*a* and 31*a* of members 30 and 31 by securing one end of web 64 to the flared end of an associated wave launching horn 62 by means of dielectric clips 90, and by securing the opposite end of web 64 to the nonported rear side wall of member segment 31*a* by means of a plurality of dielectric hooks 92. Clips 90 are arranged to cooperate with apertures provided for that purpose in the rim of horn 62 and in the associated end margin of web 64. Similarly, hooks 92, which are mounted on the side wall of segment 31*a* of member 31 so as to cooperate with apertures provided in the endwise margin of web 64. In the absence of gravity, webs 64 are adequately supported by holding them in tension between member segments 30*a* and 31*a* by means of clips 90 and hooks 92. The plurality of webs 64 are thusly arranged in spaced parallel planes orothogonally oriented with respect to the principal plane of each module 12 and antenna structure 11 as a whole.

Webs 64, as mentioned, are made of a dielectric material, and in accordance with the currently preferred embodiment, are made of a sufficiently thin sheet material so as to be flexible and capable of being wound into a compact roll for providing a desired high density form factor for being launched into orbit. For this purpose, a high strength, synthetic material having adequate dielectric characteristics, may be provided by one of a number of available polyester films, such as Mylar, a commercial name of E. I. DuPont de Nemour, Inc. The dielectric film is cut into strips of a width on the same order of magnitude as the thickness of module 11, e.g., eight inches and may have a thickness of about 0.002 inches to 0.010 inches.

In order to avoid electromagnetic interference between the plurality of G-lines 60 and the plurality of Yagi radiators 66 disposed on the separate dielectric webs 64, the spacing between adjacent lines 60 (and webs 64) is selected to provide a minimum separation of one to two wave lengths. Thus, when the antenna is operated at 2,450 megahertz where $\lambda$ equals five inches, then adjacent pairs of lines 60 and associated webs 64 should be spaced by a minimum of five inches in the plane of the antenna structure.

Figure 8:
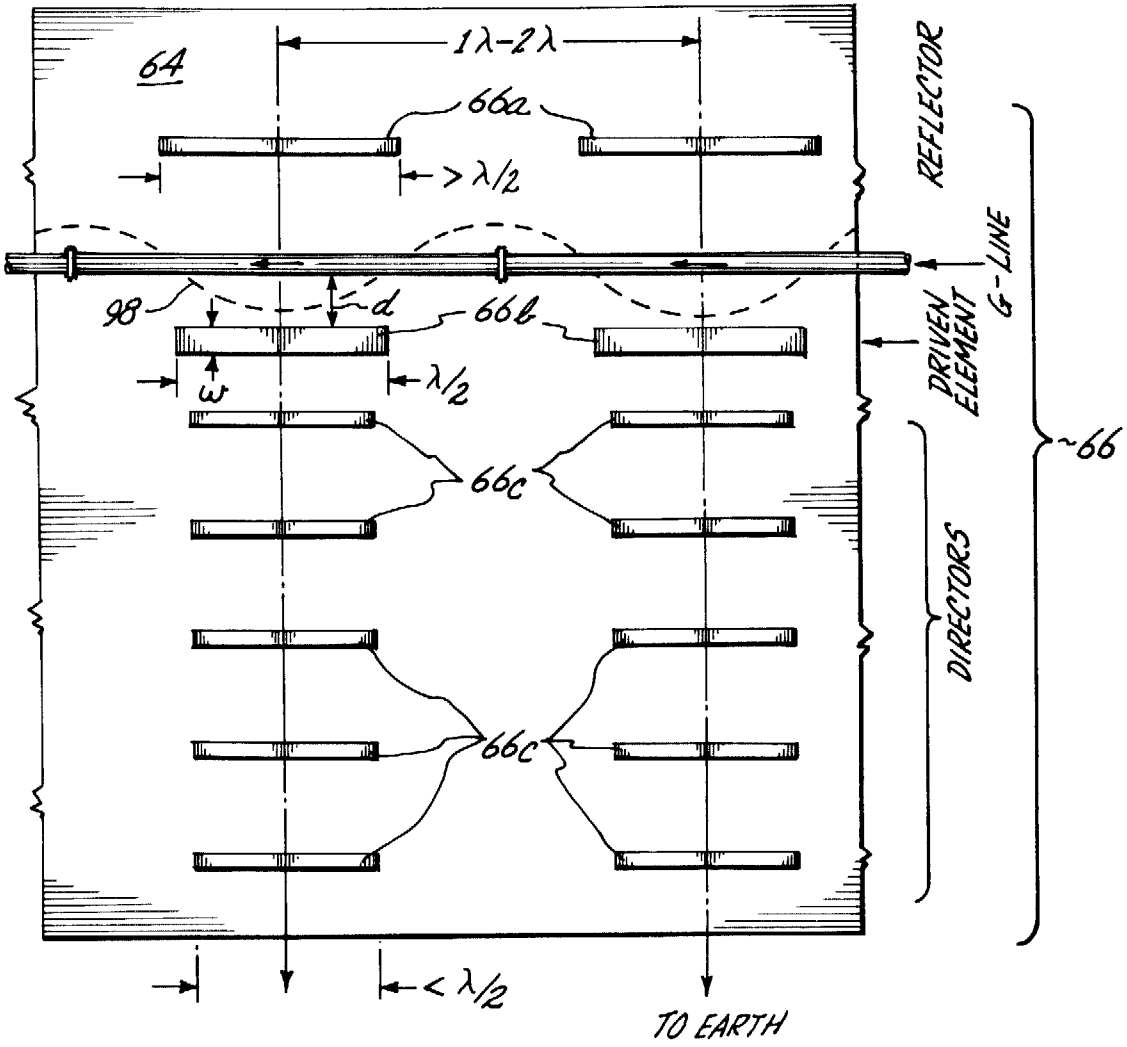
FIG. 8 is a plan view of the Goubau line, dielectric web and two adjacent Yagi radiators shown on the same scale as FIG. 7.
Figure 7:
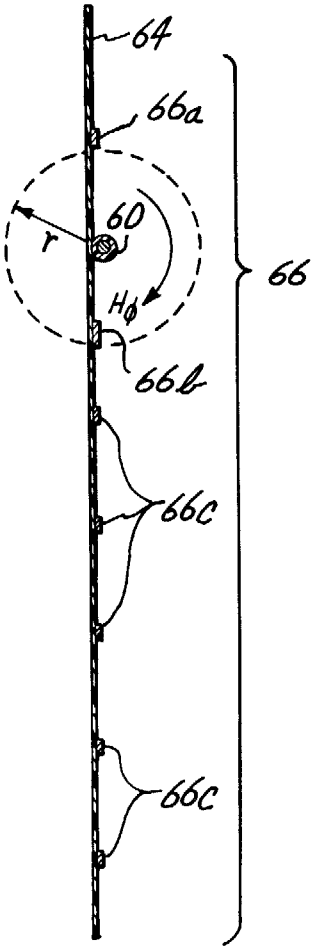
FIG. 7 is a transverse sectional view of one of the Goubau lines and associated dielectric web and Yagi radiator, shown on an enlarged scale relative to the other FIGURES.

With reference to FIGS. 7 and 8, Yagi radiators 66 are each formed by depositing or chemically etching a plurality of conductive strips of such material as copper, silver, aluminum or gold, onto one face of web 64. The individual conductive elements formed in this manner include for each Yagi radiator 66, a reflector element 66*a*, a driven element 66*b* and a plurality of director elements 66*c* arrayed in accordance with the known per se, configuration of an endfire Yagi antenna. In particular, reflector element 66*a* is usually of a length greater than that of the driver element 66*b* and director elements 66*c* and is disposed at the rear of the antenna array, opposite the end from which the gain of the antenna is at its maximum. Thus, element 66*a* is shown to have a length, i.e., the dimension transverse to the direction of radiation and parallel to the G-line 66, that is greater than $\lambda_0/2$. Driven element 66*b* is selected to have a length approximately equal to $\lambda_0/2$ so as to function as a dipole. The director elements 66*c* are selected to have lengths somewhat less than $\lambda_0/2$ and hence less than that of driven element 66*b*, in accordance with known design considerations for Yagi antennas.

The minimum separation of Yagi radiator 66 along G-line 60 and web 64 is selected to minimize the interelement interference between the Yagi radiators. The maximum dimension is selected to optimize the antenna power gain for a given available size of module 12. In the currently preferred embodiment, the centerline to centerline spacing of radiators 66 is selected within the range of a minimum of one wave length separation and a maximum of two wave lengths separation, thus corresponding to the range of preferred separation between adjacent pairs of lines 60 and webs 64 as described above. Within this range of separation, individual Yagi radiators 66 may be provided with a modest end fire gain of from 6 to 12 db.

With further reference to FIGS. 7 and 8, G-line 60 is indexed to web 64 so that line 60 is parasitically coupled to the driven element 66*b* of each of the plurality of Yagi radiators 66. Here, G-line 60 is extended along web 64 at a location lying between reflector elements 66*a* and driven elements 66*b* and is somewhat more proximate to elements 66*b*. By using the modified surface of G-line 60 to concentrate the electromagnetic field emanating therefrom to a relatively small cylinder, the major portion of the electromagnetic energy, i.e., more than 50 percent can be confined to a cylinder of radius r as shown in FIG. 7 that encompasses the driven elements 66*b* of each of the Yagi radiators 66. Furthermore, by feeding each of G-lines 60 via the internal feed wave guides of members 30–36 with electromagnetic energy of a predetermined wave length and phase, standing waves 98 of electromagnetic energy are developed along line 60. These standing waves 98, by appropriate selection of the feed wave length and phase, are in registry with the positions of driven elements 66*b* and are tuned to the $\lambda_0/2$ lengths thereof so that each standing wave causes a parasitic current flow and associated field in the corresponding driven dipole element 66*b*.

The surface modification of the G-line confines the energy in the standing wave to a region which causes the great majority of the energy to be proximity coupled to driven elements 66*b*, and substantially lesser amounts of coupling to reflector elements 66*a* and director elements 66*c*. Hence, the elements 66*b* of radiators 66 are in effect driven by the proximity coupling to line 60, and the remaining elements 66*a* and 66*c* function in their usual fashion to reflect and direct the electromagnetic energy, respectively, so it is radiated off the end of each radiator in the earthward direction as shown in FIG. 8. It has also been found that the coupling to the driven elements 66*b* is enhanced by using relatively wide conductive strips for elements 66*b*, e.g., as much as twice the width of the reflector and director elements 66*a* and 66*c*, respectively. For optimum results, and working within the constraints disclosed above, the plurality of Yagi radiators 66 are impedance matched to G-line 60 by empirically determining the most effective width $\omega$, of each of driven elements 66*b* and in combination therewith, the most effective distance d, between G-line 60 and elements 66*b*.

In the foregoing manner, it will be appreciated that a transmit antenna structure 11 is provided which is characteristically light of weight, capable of being packaged, while disassembled, in a high density configuration, for being launched into a synchronous orbit about the earth, and then assembled in orbit. The single wire transmission lines 60, especially when provided with the surface modification in accordance with the Goubau transmission line, provides an exceptionally lightweight and low lost medium for coupling electromagnetic energy from the hollow wave guides to the end fire Yagi radiators 66. Once electromagnetic energy is effectively launched onto the single wire transmission lines 60, and so long as the lines are substantially straight, which they are in the above-described configuration, then the energy is transmitted along the wire with very low losses. The power is carried in a cylindrical bundle coaxially surrounding the wire, something like a coax cable with a very large outer conductor and an air dielectric or vacuum therebetween.

Moreover, the open lattice or "see through" configuration of each of the modules that comprise antenna structure 11, is uniquely suited to the environment of an orbiting satellite. The antenna structure must be capable of withstanding such environmental effects as solar radiation and solar wind energy and meteor bombardment. The "see through" configuration allows these environmental forces to be passed through the structure without significant ill effect. Furthermore, the open configuration of each of the transmit modules, allows for effective dissipation of self-generated heat that will exist during the transmission of power due to resistive losses within the various antenna element conductors.

While only a particular embodiment has been disclosed herein, it will be readily apparent to persons skilled in the art that numerous changes and modifications can be made thereto including the use of equivalent means and devices without departing from the spirit of the invention.

For example, in the foregoing and currently preferred embodiment, each of the single wire transmission lines 60 is provided by a Goubau, surface modified conductor in order to confine the electromagnetic field surrounding the wire to a relatively small diameter cylinder. In the alternative, a bare conductor may be used for each of lines 60. Such as unmodified conductor is known as a Sommerfeldt line. Standing waves can be developed on the Sommerfeldt line in the same manner as described above for standing waves 98 developed on G-lines 60. However, the extent of the field or electromagnetic energy which surrounds the Sommerfeldt line is less concentrated, and there is a greater tendency for the field on the Sommerfeldt line to couple not only to the driven elements **66*b* of each of the Yagi radiators 66, but also to the reflector and director elements 66*a* and 66*c***, and hence reduces efficiency. A Sommerfeldt line, if used, can be provided by a hollow tubular dielectric, such as of graphite, having an overlay of a conductive metal skin such as a coating of silver.

Furthermore, the foregoing antenna structure 11 has been described in the environment of a transmit antenna suitable for being disposed as a space borne satellite in a synchronous earth orbit. Alternatively, the antenna principles disclosed above may be embodied in transmit antennas mounted in other environments. For example, an antenna structure based on the foregoing principles may be used as a receiving antenna, such as a modular ground based receiving antenna for receiving electromagnetic energy transmitted earthward by a space borne satellite antenna structure.

The embodiments of the invention in which an exclusive property or privilege is claimed are defined as follows:

1. An antenna array comprising the combination of:

frame means having first and second spaced-apart and inwardly opposing sides;

a plurality of single wire transmission lines disposed in spaced-apart parallelism and supported at opposite ends by the first and second sides, respectively, of said frame means;

a separate set of a plurality of endfire radiator means arranged at spaced intervals along each of said single wire transmission lines, each of said radiator means having a driven element, a reflector element and at least one director element cooperatively oriented so that the directive axis of each said radiator means lies transversely to the associated said single wire line, and so that said driven element is parasitically coupled to said single wire transmission line; and feed wave guide means disposed along the first of said sides and adapted for receiving a source of electromagnetic energy, said feed wave guide means including distributive coupling means for distributively coupling electromagnetic energy received from a source on to said single wire transmission lines which energy is thereupon parasitically coupled to said radiator means and radiated thereby transversely outwardly from said single wire transmission lines.

2. The antenna array of claim 1 wherein said spaced parallel single wire transmission lines are arranged in a coplanar array, and wherein each of said radiator means has its associated elements oriented in a common plane, and said common plane formed by said elements being orthogonal to the plane formed by said coplanar array of said single wire transmission lines.

3. The antenna array of claim 2, wherein said radiator means are cooperatively disposed so that their axes of maximum gain are all oriented in a common direction normal to the plane formed by said coplanar array of said plurality of single wire transmission lines.

4. The antenna array of claim 1, wherein at least one of said plurality of single wire transmission lines comprises a conductor having surface modification means that is effective to reduce the phase velocity of electromagnetic surface waves thereon to thereby concentrate the field of the transmitted electromagnetic energy about said conductor.

5. The antenna array of claim 1, wherein at least one of said single wire transmission lines comprises a Goubau transmission line.

6. The antenna array of claim 1, wherein at least one of said sets of said plurality of radiator means comprises a supportive dielectric member, and wherein said driven, reflector and director elements of the radiator means comprise strips of electrically conductive material, arranged in a coplanar array on said dielectric member, and said dielectric member being arranged proximate the associated one of said single wire transmission lines so as to cause parasitic coupling of electromagnetic energy thereon with said radiator means.

7. The antenna array of claim 6, wherein said dielectric member comprises a web of flexible material stretched between said opposing sides of said frame means, parallel and proximate to the associated one of said single wire transmission lines.

8. The antenna array of claim 6, further comprising indexing means for fixedly indexing said dielectric member and said strips thereon relative to said single wire tranmission line so as to achieve a predetermined proximate relationship between said line and said conductive strips on said dielectric member.

9. The antenna array of claim 1, wherein said feed wave guide means comprises an elongate tubular structure having electrically conductive interior walls, said tubular structure providing said first side of said frame means.

10. The antenna array of claim 9, wherein a side wall of said tubular structure that lies opposite said second side of said frame means is formed with a plurality of ports, one for each of said plurality of single wire transmission lines, that communicate with the interior of said tubular structure, and the ends of said plurality of single wire transmission lines adjacent said first side of said frame means being individually extended through separate ones of said ports in said side wall of said tubular structure and being electrically joined to an interior wall of said tubular structure.

11. The antenna array of claim 10, further comprising a plurality of surface wave launching means, one for each of said ports and associated single wire transmission lines, each of said surface wave launching means comprising horn-shaped structure disposed with the smaller end congruently attached to and surrounding the associated port in said side wall of said tubular structure and with the flared end projecting outwardly from said tubular structure and surrounding the associated one of said single wire transmission lines.

12. The antenna array of claim 1, comprising:

a second frame means having first and second inwardly opposing, spaced-apart sides;

a second plurality of single wire transmission lines disposed in spaced-apart parallelism and supported at opposite ends by the first and second sides, respectively, of said second frame means;

additional sets of pluralities of endfire radiator means cooperatively arranged at spaced intervals along each of said second plurality of single wire transmission lines; and second feed wave guide means disposed along said first side of said second frame means and adapted for receiving a source of electromagnetic energy, said second feed wave guide means including distributive coupling means for distributively coupling electromagnetic energy received from said source on to said second plurality of single wire transmission lines for being radiated therefrom by the associated sets of said endfire radiator means; and said second frame means being cooperatively arranged with said first mentioned frame means so that said first side of said first mentioned frame means forms said second side of said second frame means.

13. The antenna array set forth in claim 11, wherein said first mentioned feed wave guide means comprises an elongate tubular structure having interior conductive walls, said tubular structure being disposed and oriented so as to structurally form the first side of said first mentioned frame means and the second side of said second frame means.

14. An antenna structure comprising:

a Goubau single wire transmission line;

electromagnetic feed means, said transmission line being coupled to said feed means and terminated for causing nonradiating standing waves of electromagnetic energy to be developed on said transmission line; and at least one Yagi radiator disposed proximate said transmission line so as to be parasitically coupled thereto for being excited by said standing waves thereon and said Yagi radiator disposed with its axis of maximum gain transverse to said transmission line for radiating said electromagnetic energy transversely away from said transmission line.

15. The antenna structure of claim 14, wherein said Yagi radiator comprises a driven element, a reflector element, a director element and a supportive dielectric means for supporting said elements in a spaced-apart coplanar array, said Yagi radiator being arranged relative to said transmission line so that said driven element is capacitively and inductively coupled thereto.

16. A method of radiating electromagnetic energy, comprising the steps of:

establishing a nonradiating standing wave of electromagnetic energy on a Goubau single wire transmission line; and radiating said electromagnetic energy transversely away from said line by parasitically coupling a driven element of a multi-element Yagi radiator to said transmission line so that said standing wave thereon excites said driven element and hence said Yagi radiator, and orienting said Yagi radiator transversely to said transmission line.

17. The method of claim 16 wherein said step of establishing said standing wave is further defined as establishing at least a second standing wave on said transmission line, and said step of radiating being further defined by disposing at least one additional multi-element Yagi radiator at a position along said transmission line that is longitudinally spaced from said first mentioned Yagi radiator, and parasitically coupling a driven element of said additional Yagi radiator to said second standing wave so as to cause both said first mentioned Yagi radiator and said additional Yagi radiator to radiate phase synchronous electromagnetic energy transversely away from said transmission line.

18. An antenna structure comprising the combination of:

a sheet of flexible dielectric material;

an array of elongate conductive elements supportively affixed to said sheet, said elements being arranged in a plurality of spaced-apart subarrays, each said subarray comprising a plurality of said conductive elements arranged to form a Yagi endfire radiator; and a single wire transmission line disposed proximate to said subarrays and being adapted to receive electromagnetic energy of a frequency that causes standing waves to be developed on said line, whereby said standing waves are proximity coupled to said Yagi endfire radiators.

19. The antenna structure of claim 18 wherein said sheet of dielectric material is web shaped, and said subarrays forming said Yagi radiators are oriented so that their axes of maximum gain lie transverse to the length of said web shaped sheet of dielectric material, and are located at longitudinally spaced intervals there along.

20. The antenna structure of claim 19 wherein one of said conductive elements of each subarray serves as a driven element of the corresponding Yagi radiator, and said subarrays being arranged on said web shaped sheet of dielectric material so that said driven elements are aligned along the length of said web-shaped sheet.

21. The antenna structure of claim 20 wherein said single wire transmission line extends parallel and proximate to the aligned driven elements on said web-shaped sheet for being parasitically coupled to said driven elements.

22. The antenna structure of claim 21, wherein said single wire transmission line is a Goubau line.

* * * * *